US009612005B2

(12) United States Patent
Urtiga et al.

(10) Patent No.: US 9,612,005 B2
(45) Date of Patent: Apr. 4, 2017

(54) LED RETROFIT MODULE FOR RAILWAY SIGNALING

(71) Applicant: GE LIGHTING SOLUTIONS, LLC, East Cleveland, OH (US)

(72) Inventors: Lucas Urtiga, Laval (CA); Florian Pop, Lachine (CA); Robert Spivock, Lachine (CA); Luigi Tavernese, Montreal (CA)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 46 days.

(21) Appl. No.: 14/490,603

(22) Filed: Sep. 18, 2014

(65) Prior Publication Data

US 2015/0159849 A1 Jun. 11, 2015

Related U.S. Application Data

(60) Provisional application No. 61/879,452, filed on Sep. 18, 2013, provisional application No. 61/994,105, filed on May 15, 2014.

(51) Int. Cl.
*F21V 23/06* (2006.01)
*F21V 29/15* (2015.01)
(Continued)

(52) U.S. Cl.
CPC ..... *F21V 23/06* (2013.01); *B61L 5/1836* (2013.01); *B61L 5/1854* (2013.01); *F21V 21/13* (2013.01); *F21V 29/15* (2015.01); *F21V 33/0076* (2013.01); *B61L 2207/02* (2013.01); *F21W 2111/02* (2013.01); *F21Y 2101/00* (2013.01)

(58) Field of Classification Search
CPC ..... F21V 29/15; F21V 21/13; F21V 23/06; F21V 33/0076; F21V 17/00; F21V 19/00; F21V 19/001; F21V 19/04; F21V 19/042; F21V 19/045; B61L 5/1836; B61L 5/1854; B61L 2207/02; F21Y 2101/02; F21W 2111/02
See application file for complete search history.

(56) References Cited

U.S. PATENT DOCUMENTS 5,664,744 A 9/1997 Chew et al.
6,435,459 B1 8/2002 Sanderson et al.
(Continued)

OTHER PUBLICATIONS

PCT Search Report and Written Opinion issued in connection with corresponding Application No. PCT/US2014/056400 on Jan. 15, 2015.

*Primary Examiner* — Bao Q Truong
(74) *Attorney, Agent, or Firm* — GE Global Patent Operation; Peter T. DiMauro

(57) ABSTRACT

A railway signal replacement lamp module apparatus, including a lamp housing sized to fit within a railway signal housing and a receptacle to contain a solid state light source within the lamp housing. Some embodiments include, in combination with other aspects, at least one spring-loaded connector integral to and positioned within or on the lamp housing to interface with an electrical conductor feature of a railway signal; and a thermally conductive material disposed on an exterior surface of the lamp housing to provide a thermal conduit from an exterior of the lamp housing to an interior of the railway signal housing.

15 Claims, 9 Drawing Sheets

(51) Int. Cl.

| | |
|---|---|
| ***F21V 21/13*** | (2006.01) |
| ***F21V 33/00*** | (2006.01) |
| ***B61L 5/18*** | (2006.01) |
| *F21W 111/02* | (2006.01) |
| *F21Y 101/00* | (2016.01) |

(56) References Cited

U.S. PATENT DOCUMENTS

| | | | | |
|---|---|---|---|---|
| 7,766,518 | B2 | 8/2010 | Piepgras et al. | |
| 7,883,226 | B2 * | 2/2011 | Li | F21V 5/00 362/800 |
| 2004/0066142 | A1 * | 4/2004 | Stimac | F21K 9/137 315/50 |

* cited by examiner

LED RETROFIT MODULE FOR RAILWAY SIGNALING

CROSS-REFERENCE TO RELATED APPLICATIONS

This application claims benefit under 35 USC 119(e) of prior-filed, commonly-owned provisional patent applications 61/879,452 filed 18 Sep. 2013 and 61/994,105 filed 15 May 2014. Said provisional patent applications are hereby incorporated by reference in their entirety as if set forth fully herein.

FIELD OF THE INVENTION

The present disclosure relates to a railway signal. In particular, the present disclosure relates to a replacement module that can be retrofitted to preexisting railway signals to efficiently replace the lamps therein with high efficiency lamps.

BACKGROUND OF THE INVENTION

Many railway signals are known. However, a typical railway signal may use an incandescent bulb. In addition to better and readily available alternative bulbs such as LEDs and other light sources, an improvement on the typical screw in bulb may help ease the maintenance associated with the railway lamp device. Typical railway signals may typically house a lamp receptacle for receiving a lamp with a screw-in base. In some circumstances, such receptacles may pose a maintenance concern.

These and other aspects of known railway signals may present installation and maintenance challenges of the railway signals. Therefore, it would be desirable to provide improved methods and apparatus for efficiently retrofitting a bulb or lamp of a railway signal.

SUMMARY OF THE INVENTION

Disclosed are apparatuses and methods for providing a LED retrofit module for railway signaling including a lamp housing sized to fit within a railway signal housing; a receptacle to contain a solid state light source within the lamp housing; and at least one spring-loaded connector integral to and positioned within or on the lamp housing to interface with an electrical conductor feature of a railway signal.

In some aspects, the present disclosure includes a railway signal replacement lamp module apparatus including a lamp housing sized to fit within a railway signal housing; a receptacle to contain a solid state light source within the lamp housing; and a thermally conductive material disposed on an exterior surface of the lamp housing to provide a thermal conduit from an exterior surface of the lamp housing to an interior surface of the railway signal housing.

In some aspects, the present disclosure includes a railway signal replacement lamp module apparatus having a lamp housing sized to fit within a railway signal housing; a receptacle to contain a solid state light source within the lamp housing; at least one spring-loaded connector integral to and positioned within or on the lamp housing to interface with an electrical conductor feature of a railway signal; and a thermally conductive material disposed on an exterior surface of the lamp housing to provide a thermal conduit from an exterior of the lamp housing to an interior of the railway signal housing.

BRIEF DESCRIPTION OF THE DRAWINGS

Features and advantages of some embodiments of the present invention, and the manner in which the same are accomplished, will become more readily apparent upon consideration of the following detailed description of the invention taken in conjunction with the accompanying drawings, wherein.

DETAILED DESCRIPTION

Figure 1:
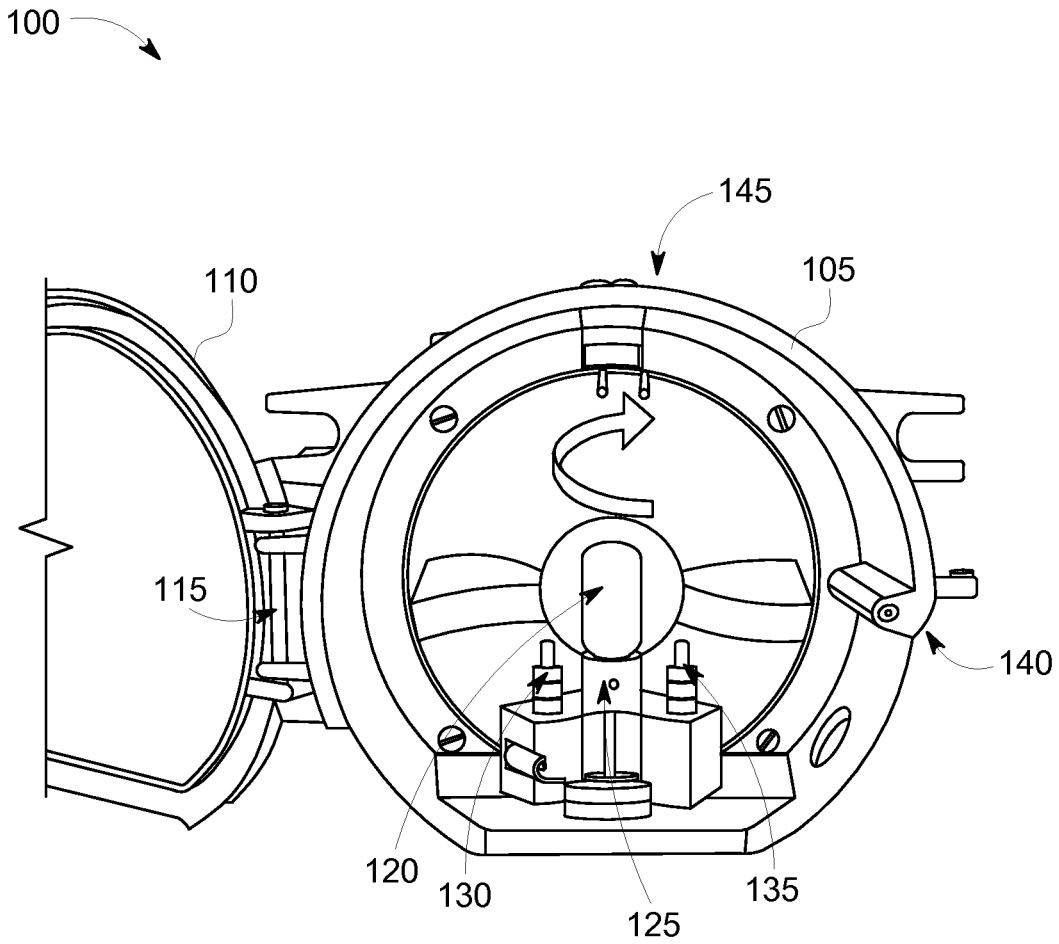
FIG. 1 is an illustrative depiction of a railway signal, according to some embodiments herein.

FIG. 1 is an illustrative diagram of a typical railway signal 100 that includes a railway signal housing 105 and a cover or back plate 110 that is attached to the railway signal housing via hinge 115 (although other types of attachments, fixed and removable, may be used such as, for example, screws, bolts, mechanical clamps, magnetic fasteners, etc.). Railway signal 100 may be representative of a variety of railway signals. As such, some features discussed and disclosed herein regarding railway signal 100 may be changed, modified, or altered without any loss of generality regarding the present disclosure. Railway signal 100 may use an incandescent bulb 120 that screws or twists into a socket 125, as is known in the art. In some aspects, a railway signal device might have a number of features that may be utilized in a novel manner per the present disclosure. For example, poles or posts 130 and 135 or other mechanical contacts (e.g., exposed screws, wire, rails, traces, etc.) may be contained within housing 115 and are both electrically conductive, have exposed areas that are electrically conductive, and connect to a power source that typically powers the bulb placed within socket 125, a switch, safety interlock, and other features In some embodiments, railway signal 100 may include a lens. Such a lens is not shown in FIG. 1 for sake of clarity and to illustrate other components of the railway signal in their installed configuration within housing 115. The lens may typically be installed over a front portion of the railway signal housing 115, opposite back plate 120. In some embodiments of the railway signal, the lens may be tinted or otherwise colored to cast a light of a particular hue when a lamp inside of the railway signal is energized.

Figure 2:
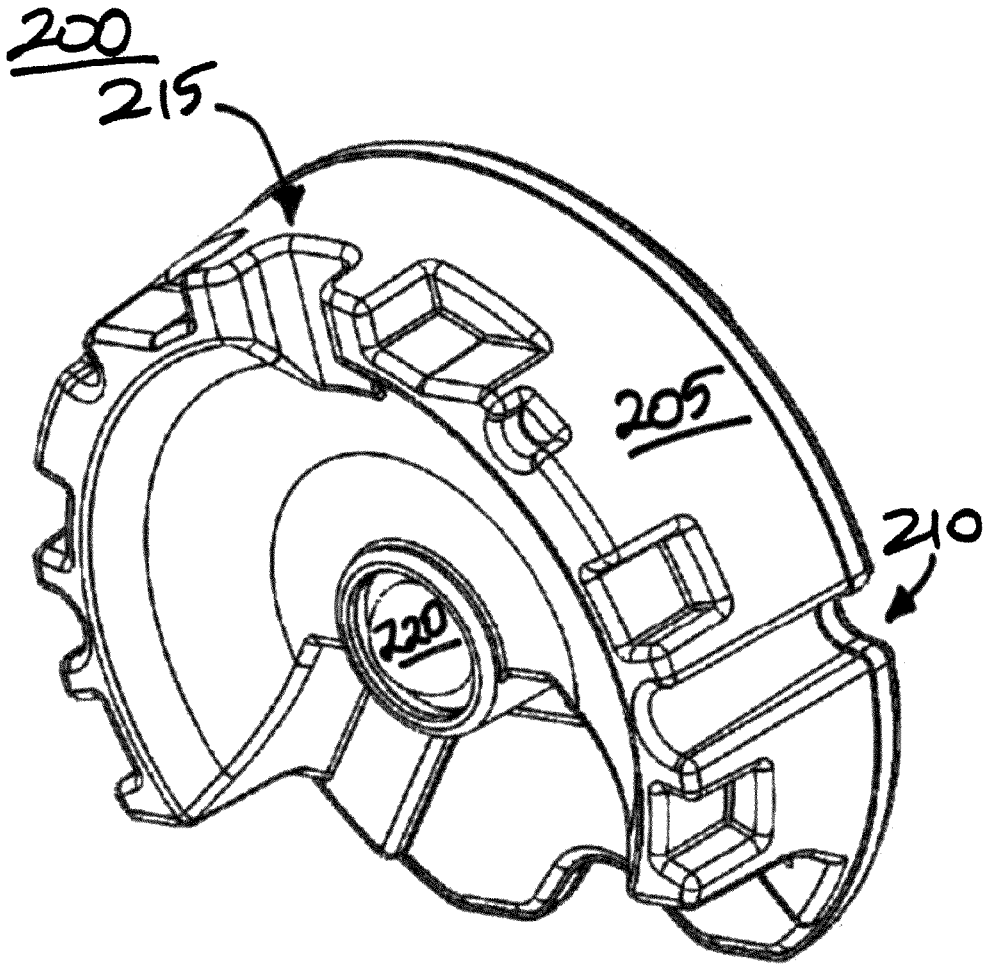
FIG. 2 is a perspective view of a LED replacement module, according to some embodiments herein.

In some embodiments herein, a LED (light emitting diode) replacement module 200 such as that shown in FIG. 2 may make use of or leverage the features of railway signal 100 in a unique manner. LED replacement module 200 itself includes a lamp housing 205 that may have a receptacle to receive or house a solid state or LED light source 220. In some embodiments, the replacement module may receive a light source such as LED light source 220 that may be removed from the replacement module. In some embodiments, a light source may not be included in the replacement module. In some aspects, light source 220 may comprise a LED light source or another type of solid state light source or a light source comprising a combination of technologies. In some aspects, the light source 220 may be of a type and variety other than LED unless otherwise stated herein. Instead of being screwed into socket 125 of the railway signal device, LED light source 220 may be received in a receptacle of the replacement module and electrically connected to (i.e., interfaced with) railway signal 100 or the like by electrical signal contacts that interface with, for example, posts 130 and 135. In some embodiments, the socket 125 is not used at all by LED replacement module 200. In some embodiments, replacement module 200 may not house a light source, although it may still provide an electrical connection or conductive pathway between a railway signal and a light source.

Other features of the railway signal may also by leveraged and used in some embodiments by a LED retrofit module of some embodiments of the present disclosure. For example, railway signal 100 might include one or more features such as protrusion(s) and concavities(s) that may be used to, for example, align LED replacement module 200 with the railway signal's housing in a proper desired orientation. In some aspects, a railway signal device includes a protrusion 145 on an interior surface of the railway signal housing 115. As such, lamp housing 205 of the LED replacement module 200 may include a corresponding void that will accept the feature (i.e., the protrusion) of the railway signal device. The cooperation between the railway signal's feature 145 and the lamp housing of LED replacement module 200 operates, in some aspects, to orient the LED replacement module relative to the railway signal in a desired position where the LED replacement module 200 matingly fits with the railway signal while making the requisite connection with posts 130 and 135.

Figure 3:
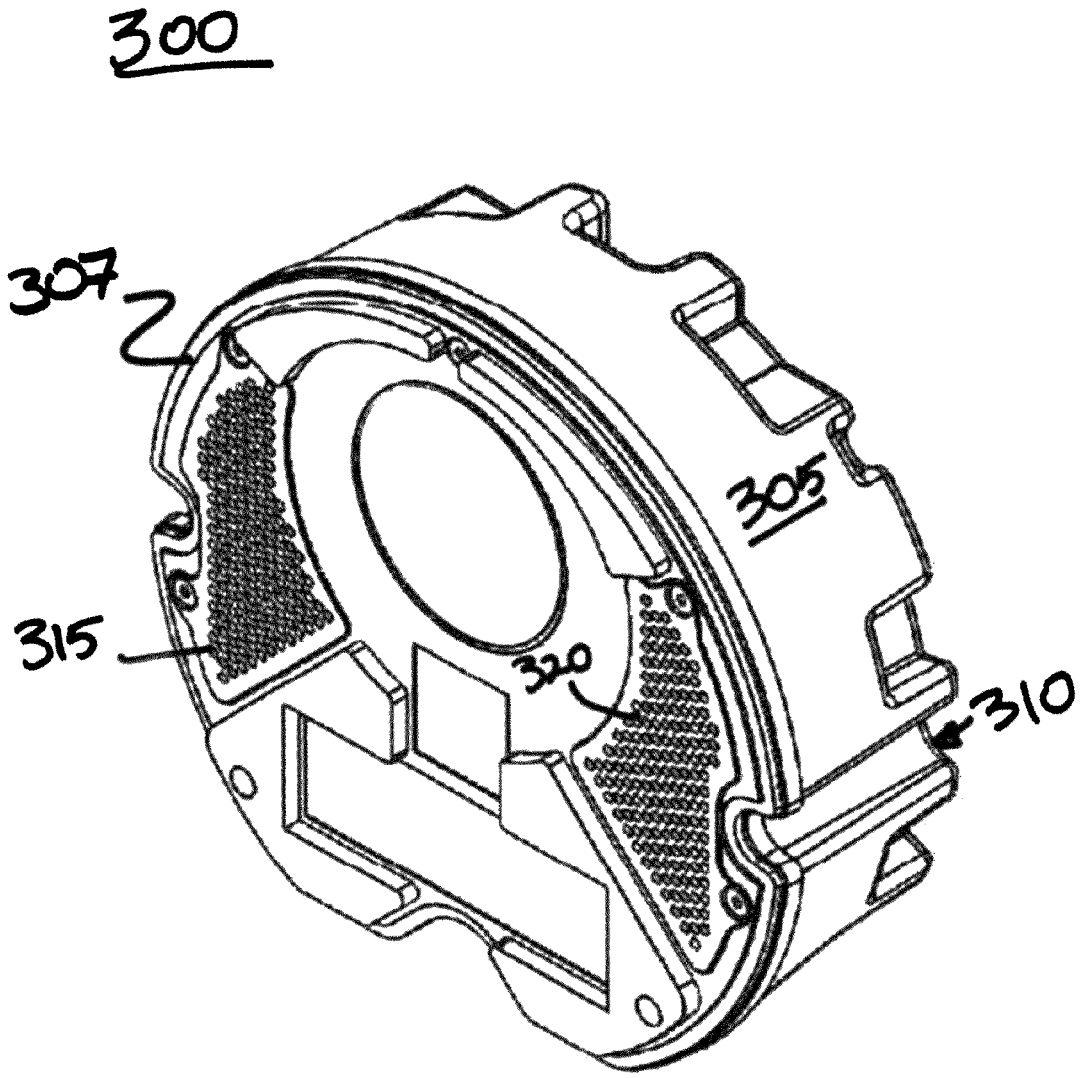
FIG. 3 is another perspective view of a LED replacement module, in accordance with some embodiments herein.

FIG. 3 is a rear perspective view of a LED replacement module 300. LED replacement or retrofit module 300 (where retrofit and replacement are used interchangeably herein) includes a lamp housing 305 and a back plate or cover 307. Back plate 307 may have one or more heat sinks 315 and 320 as shown in FIG. 3. The heat sinks may operate to help facilitate dissipation of heat that might be generated by an electrical (sub)system (e.g., a LED or other lamp, a power supply, other electrical features, etc.) housed internally within lamp housing 305. Being internally housed, such electrical components are not normally visible and as such are not shown in FIG. 3. LED replacement module 300 may also include a void 310 in lamp housing 305 that may operate to align LED replacement module 300 with a railway signal housing.

Figure 4:
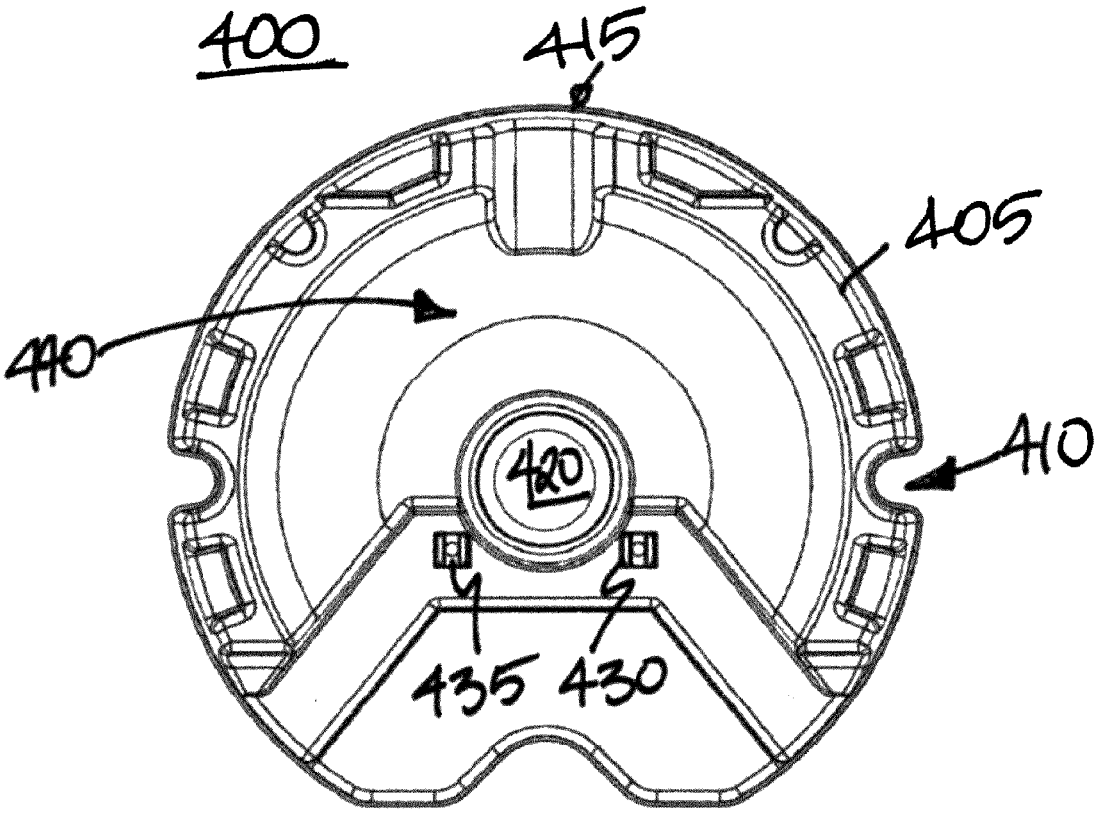
FIG. 4 is a front elevation view of a LED replacement module, in accordance with some embodiments herein.

FIG. 4 is a front elevation view of an illustrative LED replacement module 400. LED replacement module 400 includes a lamp housing 405 that may contain or hold a LED (or other type of) light source. It is noted that LED light source 420 may be located within an interior area 440 defined by lamp housing 405. LED replacement module 400 further includes one or more connectors 430 and 435 that may interface and electrically connect to the electrical features of the railway signal 100, where the electrical features do not comprise the electrical socket 125. In the embodiment of FIG. 4, connectors 430 and 435 include spring-loaded connectors that may operationally grip or grasp at least a portion of one or more opposing conductive features (e.g., conductive posts, etc.) of a railway signal. In some embodiments, connectors 430 and 435 may be integral to the replacement module's housing. Connectors 430 and 435 may be positioned immediately adjacent to and in physical contact with the one or more opposing conductive features of the railway signal when replacement module 400 is appropriately aligned with and position within a housing of the railway signal.

As illustrated in FIG. 4, connectors 430 and 435 do not include wires, that are visible or loosely routed in an exposed manner. In some embodiments, connectors 430 and 435 include electrically conductive material interfaced with LED lamp 420 so that when they are connected or coupled to a source of power LED light source 420 may be energized. In some embodiments, connectors 430 and 435 may be spring-loaded or otherwise biased connectors that might firmly grip poles 130 and 135 when position in a proper alignment configuration. Herein, void 410 may encourage and facilitate a proper alignment between mating railway signal housing 105 and LED replacement module 400, where the LED replacement module 400 may only be oriented in one specific direction.

In some embodiments, connectors 430 and 435 may be implemented in ways other than that specifically illustrated in the drawings herein. In some aspects, void 415, like void 410, may be present in LED replacement module 400 to accommodate static structural features of a railway signal housing. In this regard, it is noted that LED replacement module 100 also includes a void 115 that may be similar or the same as void 415.

In some aspects, the position of connectors 430 and 435 may be configured within LED replacement module 400 such that they align with corresponding features present in a railway signal housing. In keeping with an feature of the present disclosure, LED replacement module 400 and other LED replacement modules herein may be configured to primarily retrofit a legacy railway signal device such as, for example, railway signal 100, with a lamp that may be more efficient, brighter, longer lasting, have cooler operating temperature, and other advantages and benefits that a LED (or other light source) may offer as compared to an incandescent bulb typically used in a railway signal.

In some aspects, a LED replacement module herein may replace a incandescent bulb that, apart from the operating characteristics of the incandescent bulb which may lag a LED (or other) light source, requires a user to screw the bulb into a socket of the railway signal housing. However, an LED replacement module herein may be retrofitted into a railway signal housing by aligning the LED replacement module with the railway signal housing and sliding or pushing the lamp housing into the railway signal housing until the connection(s) of the LED replacement module engage and connect with one or more conductive electrical "features" of the railway signal device. In some embodiments, when the connector(s) of the LED replacement module engages and connects (i.e., interfaces) with the one or more "features" of the railway signal device, the LED replacement module is preferably securely seated within the railway signal housing. Accordingly, a LED replacement module herein may not require or use the railway signal's socket, may feature a single action install such as, for example, a one axis snap-on or slide-in coupling with the railway signal housing, and obviate the need for any additional wires or electrical cables.

Figure 5:
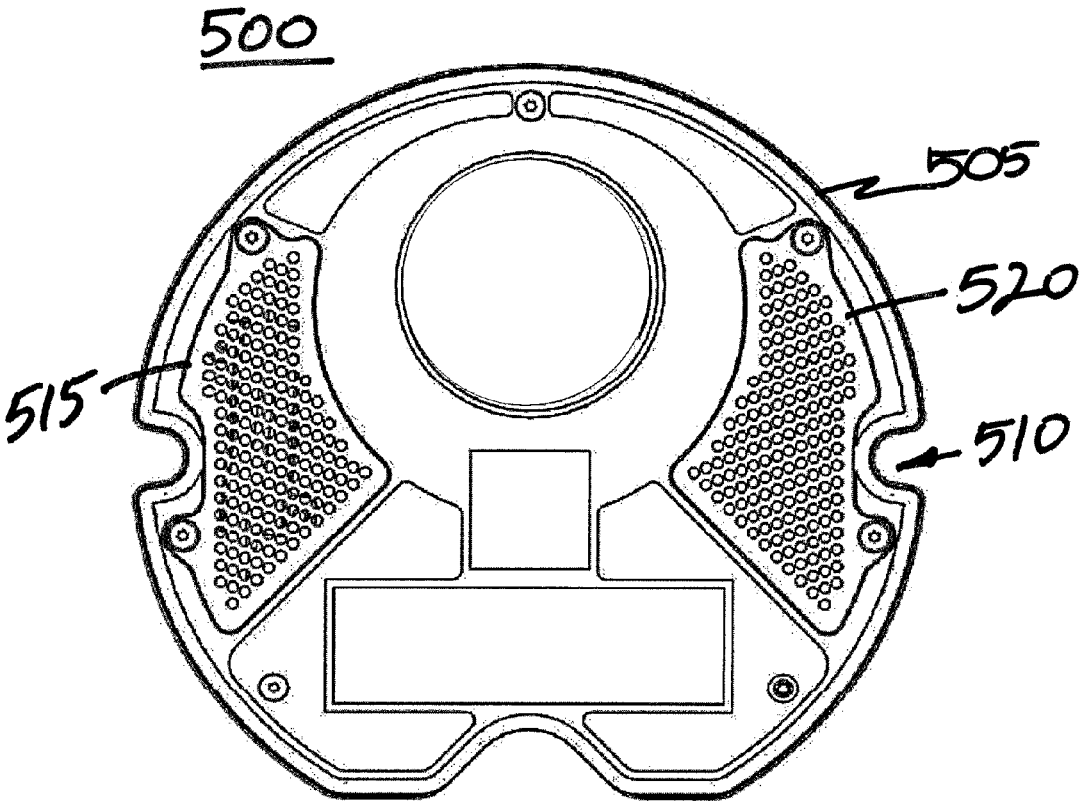
FIG. 5 is rear elevation view of a LED replacement module, according to one embodiment herein.

FIG. 5 is a rear view of a LED replacement module 500 that includes a lamp housing 505 and an alignment feature 510, which may be similar to other such features discussed hereinabove. Moreover, LED replacement module 500 includes one or more heat sinks or other heat dissipation elements 510 and 515. Heat sinks 510 and 515 may be provide on LED replacement module 500 to facilitate dissipating heat generated by, in some use-cases, an electrical component, device, (sub)system (not shown) that is housed within the LED replacement module. It is noted that the shape, size, number, and particular placement of heat sinks 515 and 510 may be added to, altered, modified, or deleted depending the need for heat dissipation for a given implementation and embodiment.

Figure 6:
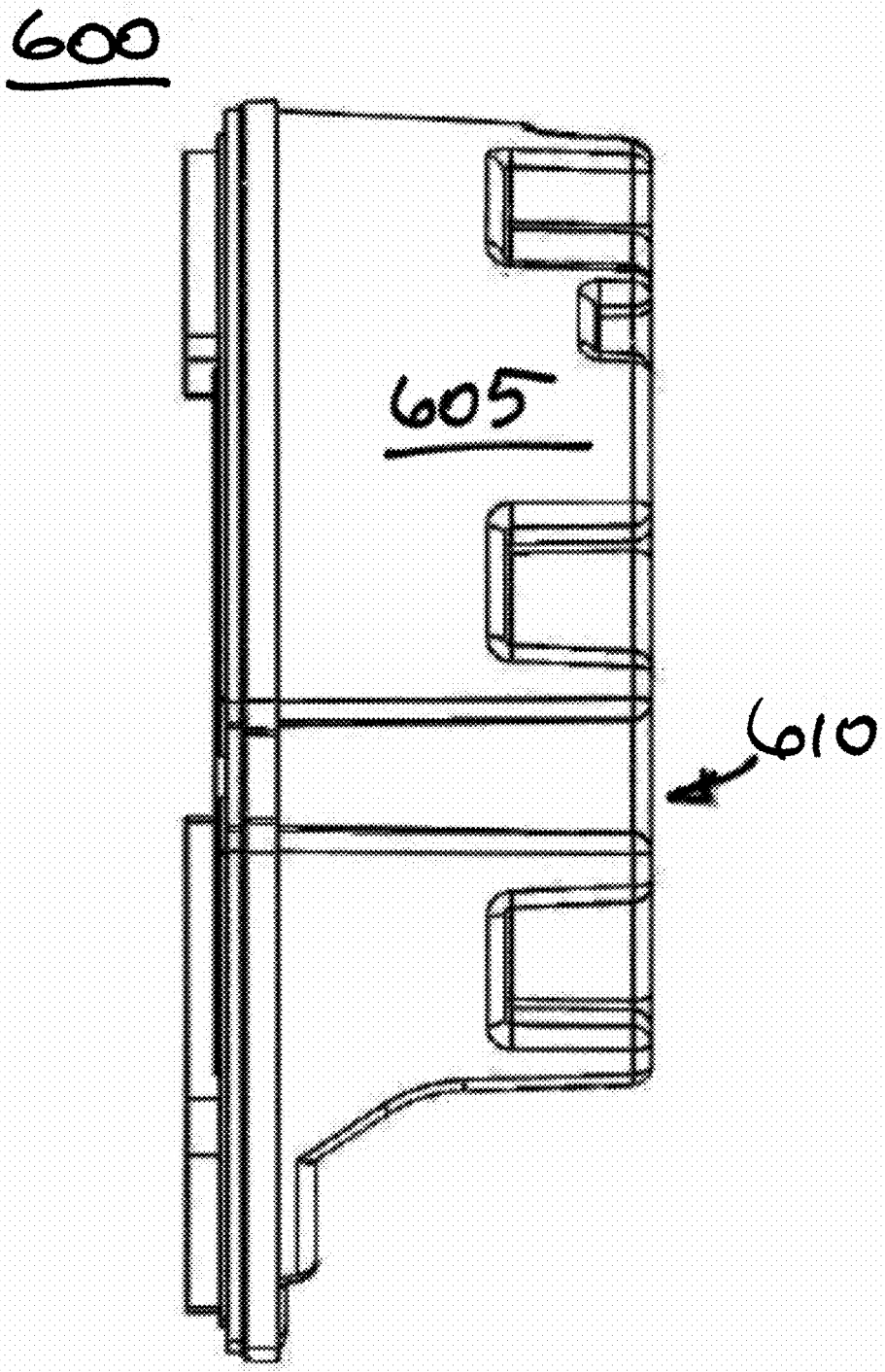
FIG. 6 is a side elevation view of a LED replacement module, according to some embodiments herein.
Figure 7:
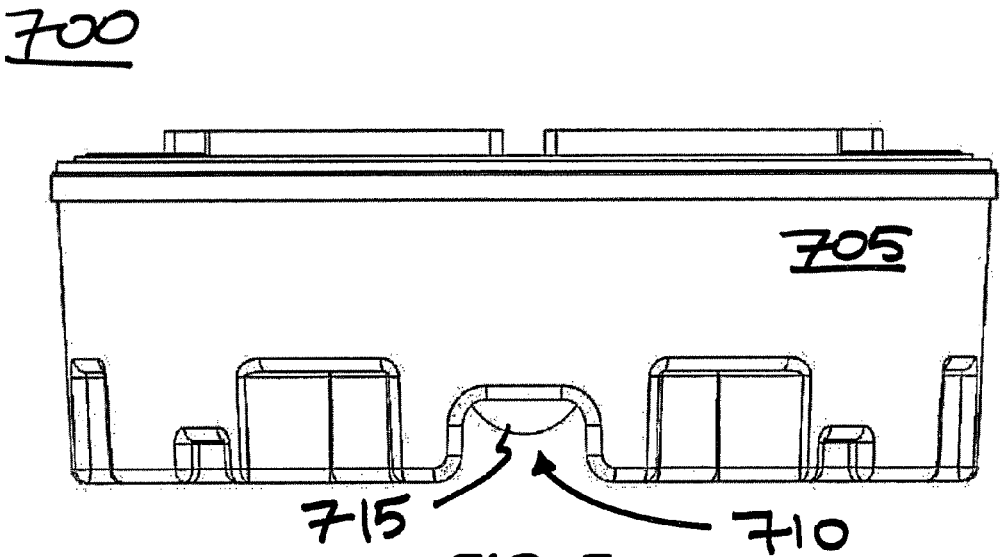
FIG. 7 is a top front elevation view of a LED replacement module, according to some embodiments herein.
Figure 8:
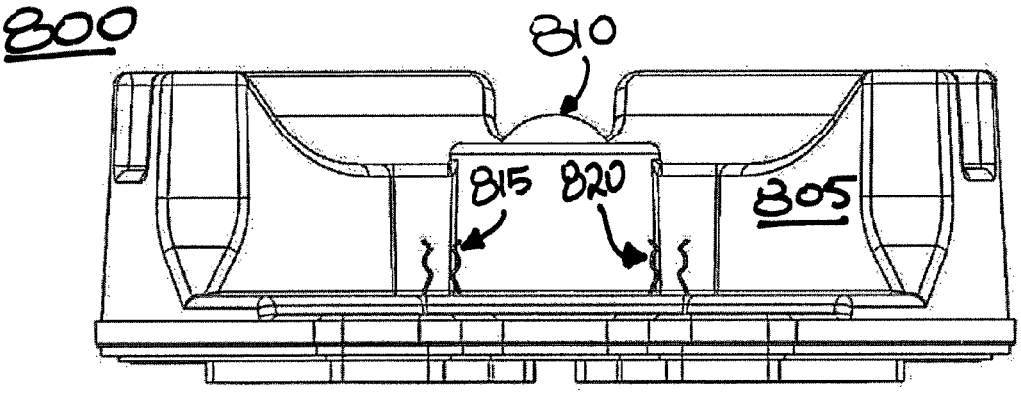
FIG. 8 is bottom elevation view of a LED replacement module, according to some embodiments herein.

FIG. 6 is a side elevation view of a LED replacement module 600. LED replacement module has a lamp housing 605 and an alignment feature 610 as discussed above (e.g., 510). FIGS. 7 and 8 include a top plan view and a bottom plan view, respectively. FIG. 7 includes a lamp housing 705 and a LED lamp 715. Additionally, an alignment feature 710 may be incorporated into lamp housing 705 to accommodate a configuration feature of a railway signal housing. FIG. 8 includes a lamp housing 805 and a LED lamp 810. As shown, connectors 815 and 820 are provided to interface with electrical features of a railway signal other than a bulb socket. Additionally, an alignment feature 710 may be incorporated into lamp housing 705 to accommodate a configuration feature of a railway signal housing. In some aspects, connectors 815 and 820 may include electrically conductive material that may be spring loaded (i.e., biased) or otherwise positioned to matingly interface with electromechanical features present in a railway signal housing. In some embodiments, the electromechanical contacts may operate clip to existing posts of a railway signal housing. This method of connecting the LED replacement module may effectively and efficiently replace the conventional screw-in method of connecting a lamp or bulb into a railway signal.

In some embodiments a thermally conductive feature or material such as, for example, a foam-like material, may be added to or used in conjunction with the LED replacement module(s) disclosed herein. The foam-like material may be a thermally conductive material that thermally connects, through conduction, a (metal) heat sink on the LED replacement module to the metal housing and the door of a railway signal housing. In some respects, the foam feature herein that might connect the heat sink of the LED replacement module to the metal housing and the back plate or door of the railway signal housing. In some regards, the thermal foam-like material may preferably have the characteristic of 1.0 W/m-K, which is about 40 times more conductive than air. Accordingly, the foam-like, viscoelastic feature(s) herein may provide the benefit of facilitating the dissipation of heat generated by a railway lamp that includes the LED replacement module herein. In some aspects, the foam-like material may also help in providing a 'snug' fit between the replacement lamp module and the railway signal's housing when the foam-like material is placed therebetween.

Figure 9:
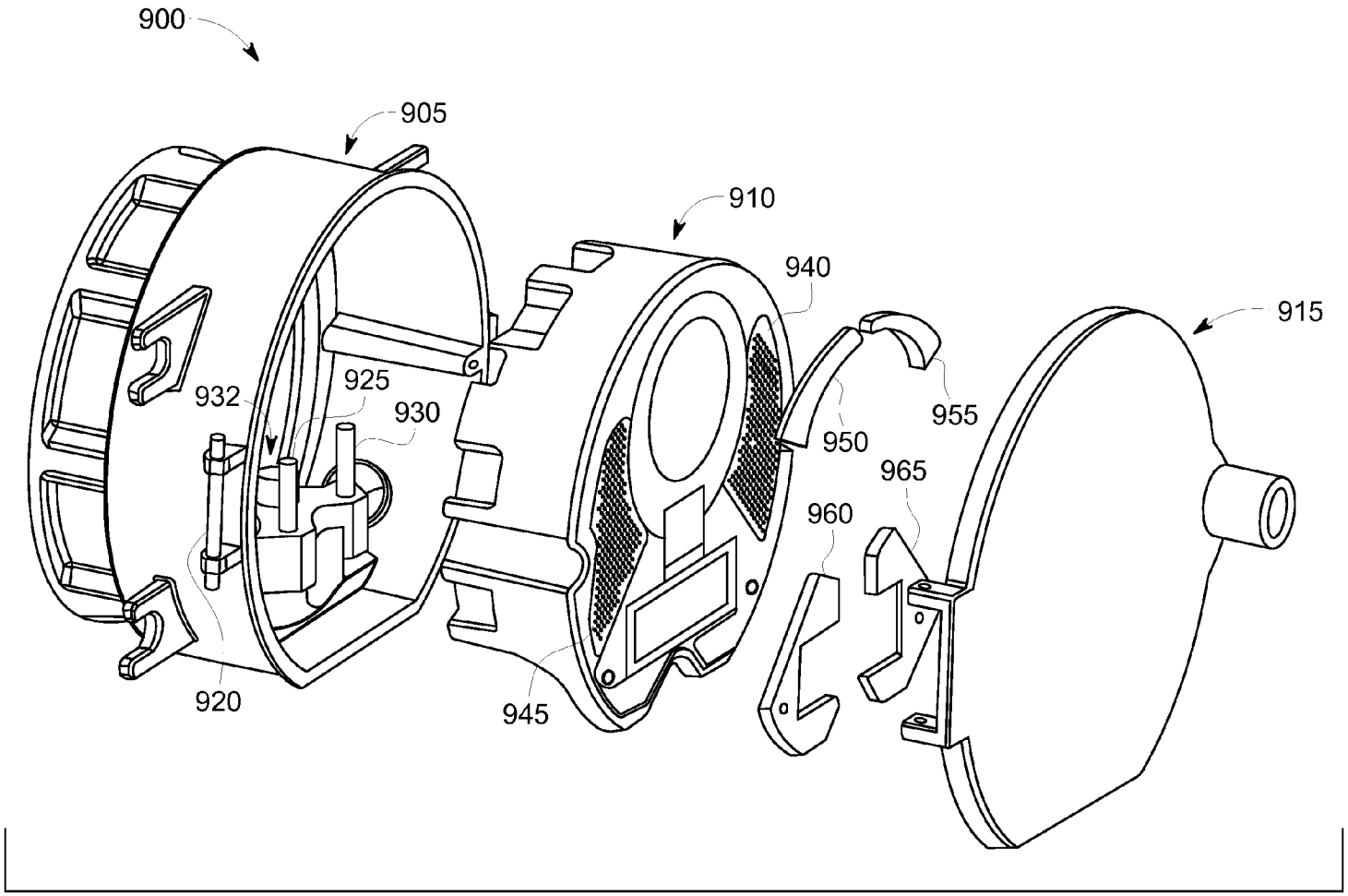
FIG. 9 is an illustrative depiction of a system including a LED replacement module.

Referring the FIG. 9 a system or apparatus 900 is illustrated. The system includes a railway signal housing 905 into which an embodiment of the LED replacement module herein (e.g., 910) fittingly mates. As illustrated in FIG. 9 and as also explained hereinabove, LED replacement module 910 may electrically connect to one or more electrically conductive features of the railway signal lamp by one or more mechanisms of the LED replacement module. As shown in FIG. 9, railway signal housing 905 includes a first post 925 and a second post 930. Both posts 925 and 930 may be electrically conductive and, in some aspects, provide an electrical connection or pathway between the railway signal's power source and the LED (or other type of light source) contained within LED replacement module 910. As such, the LED replacement module may electrically connect to the railway signal housing without interfacing with socket 932, at least not the screw-in aspects thereof.

FIG. 9 further shows at least one piece of thermally conductive foam-like material 950, 955, 960, and 965 placed between the back or rear exterior of the LED replacement module and the railway signal's cover 915. In some aspects, cover 915 pivots open and close at hinge 920. When closed there might not be much space between the exterior back of the LED replacement module 910 and an inner face or interior of cover 915. In some aspects, a thermally conductive material 950, 955, 960, and 965 may be disposed on an exterior surface of the replacement module's lamp housing to provide a thermal conduit from an exterior of the lamp housing to an interior of the railway housing. In some aspects, the exterior wall surface of the replacement module's lamp housing 910 may be positioned adjacent to or proximate to an interior wall surface of the railway signal housing 905 when the replacement module is matingly fitted within an interior space defined by the railway signal's housing 905.

Accordingly, positioning or otherwise placing foam-like thermally conductive pieces between the lamp housing of the LED replacement module and the cover of the railway signal may typically result in a tight fit wherein the foam pieces will be in close proximity or contact with both the LED replacement module's lamp housing and the cover of the railway signal. In this manner the thermally conductive foam-like material may cooperate with heat sinks 940 and 945 to more efficiently transfer and dissipate heat from the LED replacement module.

In some aspects, the thermally conductive foam-like material feature disclosed herein has a number of characteristics which, alone or in combination with other aspects of the present disclosure, provides a number of benefits to the LED replacement module herein. In some aspects, the foam-like material may have one or more of the following characteristics:

Thermal conductivity: 1.0 Wm-K
Highly conformable, low hardness;
"Gel-like" modulus;
Decreased strain
Puncture, shear and tear resistant
Electrically isolating The thermally conductive foam herein may be suited for applications such as those that require a minimum amount of pressure on components. The viscoelastic nature of the material also provides excellent low stress vibration dampening and shock absorbing characteristics. The material is an electrically isolating material, which allows its use in applications requiring isolation between heat sinks and high-voltage, bare-leaded devices.

Figure 10:
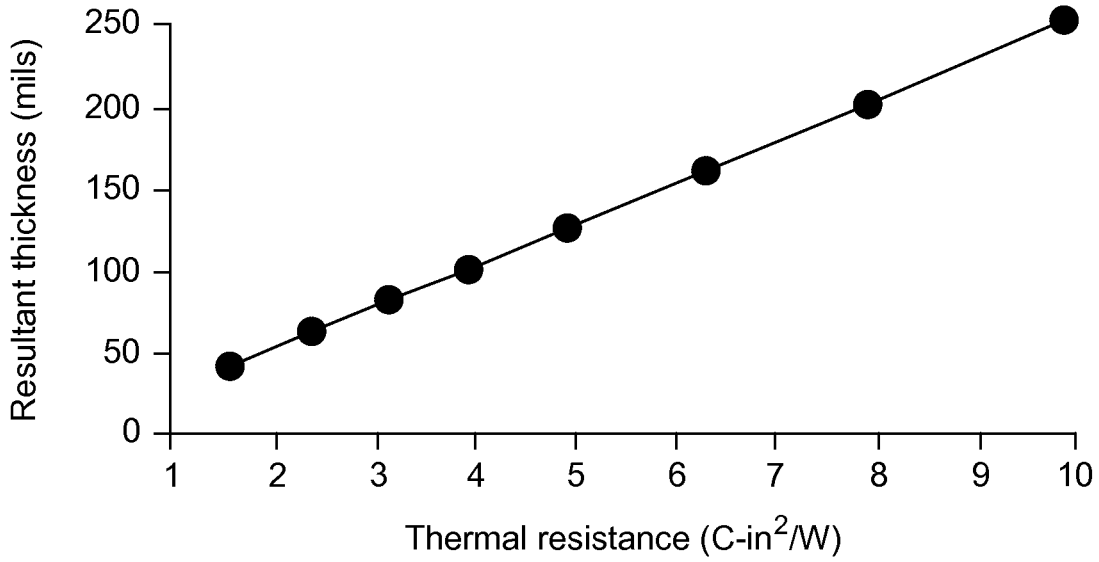
FIG. 10 is a graph of characteristics associated with some aspects herein.

FIG. 10 is a graph illustratively showing a relationship between the thickness of a thermally conductive foam-like material that may be used in accordance with the present disclosure, including a thickness of the material and its thermal resistance. Regarding FIG. 10, the resultant thickness is defined as the final gap thickness of the application.

Embodiments have been described herein solely for the purpose of illustration. Persons skilled in the art will recognize from this description that embodiments are not limited to those described, but may be practiced with modifications and alterations limited only by the spirit and scope of the appended claims.

What is claimed is:

1. A railway signal replacement lamp module apparatus, the apparatus comprising:

a housing sized to matingly fit within a railway signal housing;

a receptacle to contain a solid state light source within the housing; and at least one spring-loaded connector integral to and positioned within an interior of the housing to interface with an electrical conductor feature of a railway signal, wherein an exterior wall surface of the housing apparatus is adjacent to an interior wall surface of the railway signal housing when the housing is matingly fitted within an interior space defined by the railway signal housing.

2. The apparatus of claim 1, wherein the at least one spring-loaded connector integral to the housing interfaces with the electrical conductor feature of the railway signal when the housing is disposed within an interior space defined the railway signal.

3. The apparatus of claim 1, wherein the solid state light source comprises at least one light emitting diode.

4. The apparatus of claim 1, further comprising a solid state light device disposed in the receptacle to contain a solid state light source.

5. The apparatus of claim 1, wherein the at least one spring-loaded connector comprises two spring-loaded connectors to interface with two vertical conductive posts features of a railway signal.

6. A railway signal replacement lamp module apparatus, the apparatus comprising:

a housing sized to matingly fit within a railway signal housing;

a receptacle to contain a solid state light source within the housing; and a thermally conductive material disposed on an exterior surface of the housing to provide a thermal conduit from an interior of the housing to an exterior of the housing, wherein the thermally conductive material disposed on the exterior wall surface of the housing apparatus is adjacent to the interior wall surface of the railway signal housing when the housing is matingly fitted within the interior space defined by the railway signal housing; and wherein an exterior wall surface of the housing apparatus is adjacent to an interior wall surface of the railway signal housing when the housing is matingly fitted within an interior space defined by the railway signal housing.

7. The apparatus of claim 6, wherein the solid state light source comprises at least one light emitting diode.

8. The apparatus of claim 6, further comprising a solid state light device disposed in the receptacle to contain a solid state light source.

9. The apparatus of claim 6, wherein the thermally conductive material comprises a foam-like viscoelastic material.

10. A railway signal replacement lamp module apparatus, the apparatus comprising:

a housing sized to matingly fit within a railway signal housing;

a receptacle to contain a solid state light source within the housing;

at least one spring-loaded connector integral to and positioned within an interior of the housing to interface with an electrical conductor feature of a railway signal; and a thermally conductive material disposed on an exterior surface of the housing to provide a thermal conduit from an interior of the housing to an exterior of the housing, wherein an exterior wall surface of the housing apparatus is adjacent to an interior wall surface of the railway signal housing when the housing is matingly fitted within an interior space defined by the railway signal housing.

11. The apparatus of claim 10, wherein the at least one spring-loaded connector integral to the housing interfaces with the electrical conductor feature of the railway signal when the housing is disposed within an interior space defined the railway signal.

12. The apparatus of claim 10, wherein the solid state light source comprises at least one light emitting diode.

13. The apparatus of claim 10, further comprising a solid state light device disposed in the receptacle to contain a solid state light source.

14. The apparatus of claim 10, wherein the at least one spring-loaded connector comprises two spring-loaded connectors to interface with two vertical conductive posts features of a railway signal.

15. The apparatus of claim 10, wherein the thermally conductive material disposed on the exterior wall surface of the housing apparatus is adjacent to the interior wall surface of the railway signal housing when the housing is matingly fitted within the interior space defined by the railway signal housing.

* * * * *